United States Patent [19]

Maue

[11] 4,206,592

[45] Jun. 10, 1980

[54] TIMEPIECE FOR IDENTIFYING TIME BY COLOR

[76] Inventor: Marilyn J. Maue, 20 Melwex St., Belleville, N.J. 07109

[21] Appl. No.: 491,530

[22] Filed: Jul. 24, 1974

Related U.S. Application Data

[63] Continuation of Ser. No. 129,543, Mar. 30, 1970, abandoned, and a continuation-in-part of Ser. No. 696,940, Jan. 10, 1968, Pat. No. 3,616,643.

[51] Int. Cl.[2] ..... G04B 19/06

[52] U.S. Cl. ..... 368/233; 368/228; 368/77

[58] Field of Search ..... 58/50 R, 57, 125 R, 58/125 B, 126 R, 126 A, 127 R, 128, 152 F, 152 G, 1 R; 116/129 E

[56] References Cited

U.S. PATENT DOCUMENTS

| | | | |
|---|---|---|---|
| 797,219 | 8/1905 | Porter | 58/127 R |
| 908,786 | 1/1909 | Longtine | 58/127 R |
| 1,572,097 | 2/1926 | Walters | 58/127 R |

FOREIGN PATENT DOCUMENTS

| | | | |
|---|---|---|---|
| 252560 | 1/1948 | Switzerland | 58/127 |

*Primary Examiner*—Ulysses Weldon
*Attorney, Agent, or Firm*—Marilyn J. Maue

[57] ABSTRACT

The present invention relates to a timepiece for indicating time by distinguishable colors, each corresponding to a standard unit of a time period. The units of the time period are represented by a plurality of uniform sections each differentiated by a distinguishable color and carried in a display area of a substantially flat annular member, preferably having a thickness or depth not more than ¼ its diameter. The proper unit of the time period is indicated by reference means which may be a separate indicator or which may be carried on a separate cover member positioned above the display portion or area so as to indicate each of the distinguishable colors of the time period successively upon uniform, incremental and rotational movement between the reference means and the display portion carried by the annular member. The successive uniform rotational movement between each section and the point of reference is effected by a standard timepiece driving means. The timepiece of the present invention may be of various sizes adapted for commercial or personal use.

18 Claims, 10 Drawing Figures

Figure 1:
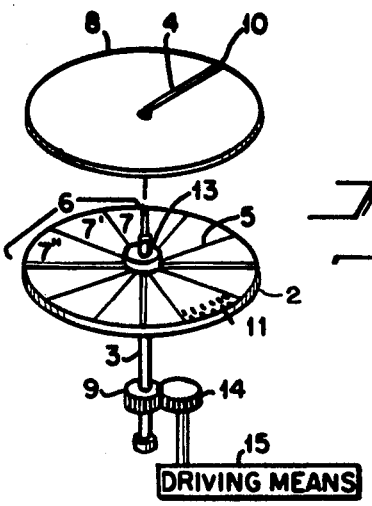

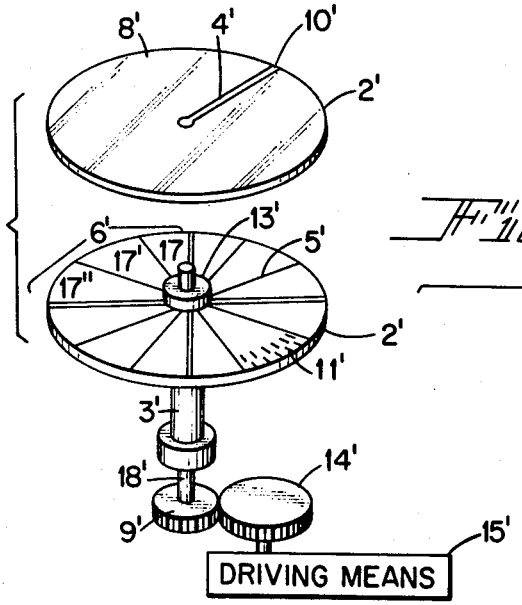
Fig. 1A
Fig. 5A
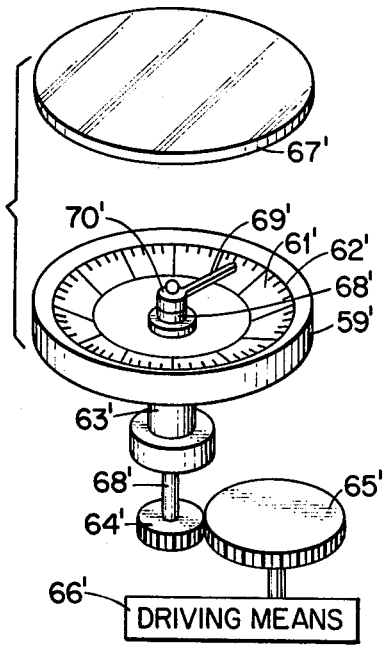

TIMEPIECE FOR IDENTIFYING TIME BY COLOR

This is a continuation of application Ser. No. 129,543, filed Mar. 30, 1970, now abandoned, and a continuation-in-part of my copending application, Ser. No. 696,940, filed Jan. 10, 1968, now U.S. Pat. No. 3,616,643.

It is an object of the present invention to provide a new concept in a timepiece wherein time is indicated by color. Another object is to provide a timepiece which indicates at least one period of time without the assistance of numerals and/or uniformly spaced and identically colored markings. Another object is to provide a timepiece lacking a face dial and lances. Still another object is to provide a timepiece wherein hours and minutes are simultaneously identified by the movement of a single indicating means. These and other objects will become apparent from the following description and disclosure.

According to this invention, uniform divisions or units of a given period of time are indicated by distinguishable color changes in an arrangement wherein each distinguishable color represents a uniform division of the time period, such as for example, a 5-, 10-, 15- or 20-minute division of an hour period or, alternatively, one hour of a 12- or 24-hour period. The present timepiece comprises at least 3 essential component parts, namely, (1) an annular color carrying member on which the distinguishable colors defines the uniform sections in a display portion on a surface of the annular member; (2) a reference means or member mounted or positioned over the display portion of the annular member to successively indicate each distinguishable color corresponding to a time division in a given period as one member is rotated with respect to the other; and (3) driving means of a standard timepiece mechanism adapted to rotate one member with respect to the other, preferably by means of a shaft connecting the rotatable member to a standard timepiece driving mechanism. In the above arrangement, the reference means can be an indicator member which is attached to the casing or to a member other than the annular member, e.g., a shaft causing it to rotate. The arrangement may additionally include a cover member mounted above the annular member and may be a separate part of the arrangement where it is mounted above the reference means or it may be adapted to include the reference means which may be an aperture in the cover member or a bar or pointer carried thereon. When the cover member is employed it is adapted to disclose at least one of the distinguishable colors of the display area on the annular member above which it is positioned.

Although one or more time periods of the present timepiece can be identified by color, it is preferable that only one period be identified by the distinguishable color changes and that the remaining time period or remaining time periods be indicated by means which are well known in the art, such as for example, a revolving tape carrying numerals, lance and dial, uniformly spaced markings successively positioned on a time scale, cumulative placement of stones or markers in apertures whose number corresponds to the divisions within a time period as in a ball and pallet arrangement and other well known means. Numerical identification of a calendar date is widely advertised as, for example, on pages 7 and 24, section 6 of the Sept. 22, 1970 issue of the New York Times. The digital watches and desk clocks produced by several major watch and clock manufacturers provides examples of hour or minute indication by numerals which can be employed in the present timepiece. The successive markings on a time scale for indicating one period of time is described and illustrated in U.S. Pat. No. 2,411,597. The present description and disclosure is directed to the period of time which is indicated by distinguishable color changes as the novel aspect of the invention.

The rotatable member of the present timepiece, whether the reference member or the annular member, is arranged to be driven by a suitable clock movement of substantially conventional construction. The source of power for the timepiece can be any heretofore applied such as, for example, electrical or mechanical. The driving means comprises an uncoiling spring or a falling weight which actuates a train of gear wheels for transmission of power to the movement of the movable member of the present timepiece. The timepiece usually includes an escapement controlling the mechanism's rate of speed to provide uniform movement by converting circular force of the escape wheel into an oscillating motion of the regulating device, e.g., foliot, balance wheel, pendulum, or any other regulating device. In one embodiment, the rotatable member of the present invention can be connected to a pinion wheel or a pinioned shaft on which the lance of an ordinary timepiece is otherwise mounted and thus can be rotated in the same manner as the lance within a predetermined period of time. In another embodiment, the periphery of the annular member or the cover member can be adapted by means of gear teeth to engage the hour or the minute gear wheel connected to the driving means of an ordinary timepiece driving mechanism and which normally imparts movement to the hour or minute hand of the timepiece. It is to be understood that the present timepiece may include any of the adjunct features provided in timepieces currently marketed.

The annular color carrying member of the present invention is a substantially flat body such as a disk, a plate or a hollow case having upper and lower-inside and outside surfaces or a wheel having a continuous solid surface diameter. An area in which the distinguishable colors appear is defined as the display portion of the annular member. The display portion can occupy any part of the visible surface of the annular member. However, it cannot be disposed around the rim or be affixed thereto, e.g., as a tape mounted on the rim, since this arrangement would fall in the category of the cylindrical color carrying member which is the subject of my above referenced copending application Ser. No. 696,940. Thus, the display portion can occupy the entire surface of the diameter or a divided annular portion, of the same or varied dimensions, on the diameter surface of the annular member, such as a color band, a scale or a spiral configuration around the surface diameter of the annular member. The distinguishable colors are arranged in uniform or varied areas within the uniformly spaced sections of the display portion and appear in any convenient configuration, such as for example, bars; bands; stripes; a plurality of color dots or specks; triangular, spherical, square, oval or irregular bodies or areas of color or varied patterns of color. Accordingly, the specific colors can be applied in any convenient manner, e.g., the colors may be painted, etched, or engraved in the display area, color swatches may be affixed in the sections of the display portion, or one or more colored bodies can be embedded, mounted or freely movable in each of the sections of the display portion. Also, any combinations of these arrangements for imparting color or displaying colors of the color arrangement may be employed. A more complete description of particular and distinct colors, color blending, color shades and intensity, color pattern arrangements and shapes of color bodies which are suitably employed to provide the distinguishable colors in the color arrangement of the present timepiece is provided in my copending application, Ser. No. 696,940, filed Jan. 10, 1968.

When the annular member is a flat hollow case, the interior can be partitioned by panels to provide separate color sections and particles or color bodies of a distinguishable color can occupy each section in a fixed pattern or can be capable of free movement within the confines of each section. The confines of each section of the case comprise at least one pair of dividers or panels, the upper inside surface and the lower inside surface of the hollow case. If desired, the panels can be positioned radially as the spokes of a wheel to provide cuneiform sections with the rim of the case. Alternatively, each section of the case can be bounded on four sides by panels or dividers within the case. When the annular color carrying member is a case containing color bodies which are freely movable in each section, it is preferable to rotate the case so that, with each successive positioning of the distinguishable colors at the point of reference, the pattern of the distinguishable color may be varied. Although the dimensions of the case can be of any desirable diameter and thickness, it is preferred that the height of the inner void (i.e., the approximate thickness of the case), not exceed one-fourth the diameter of the inner space.

The underside or rim portion of the annular member may be beveled to engage the gear wheel of an ordinary timepiece driving mechanism. As an alternative, the annular member or the cover member can be axially mounted on a shaft which otherwise would carry a lance of a standard timepiece and thus be rotated by engagement with the standard gear wheel of an ordinary driving mechanism. Also a separate reference member can be individually mounted on a shaft geared to engage the gear wheel of the driving mechanism, while the annular member is stationary. In this case, where a non-opaque cover member is also employed, both the cover member and the annular member may remain stationary as the separate reference means is rotated.

When employed, the cover member of the present timepiece preferably overlays the display portion of the annular color carrying member. The cover member is preferably adapted to cover all portions of the display area but not necessarily all portions of the annular member and can be an apertured opaque or translucent plate or a transparent plate carrying or being mounted above reference means indicator as a point of reference. When the cover member is rotated to display the distinguishable colors, it is preferably an annular body and the reference means is carried thereon. However, when the cover member is fixed, the reference means or point indicator can be carried thereon or can be separately mounted, preferably below the cover member. The contour of the cover member can follow the contour of the display area portion of the annular member or can have a different shape. For example, a flat disk having a display portion disposed on its upper surface can be rotated under a substantially rectangular cover member having an aperture or reference point positioned so that each of the distinguishable colors are indicated successively as the annular member is roatated in a clockwise or counter-clockwise manner.

In the instance of the opaque cover member having an aperture or window, it is preferred that the aperture or window reveal not more than two neighboring distinguishable colors, the remaining colors of the color code being masked below the opaque surface. The window or aperture may additionally carry or be associated with an additional point of reference when it is desirable to indicate standard intervals corresponding to markings or subdivided areas within the color section displayed in the window of the cover member to simultaneously represent a time unit of the time period and a subdivision of the time unit. The separate indicator or reference means is then adapted to coincide with indica on the display surface of each color section as it is positioned at the point of reference. For example, each color section may carry five markings across its section of color to indicate 10-minute intervals within an hour color band of a 12-hour period represented by 12 distinguishable bands of color and a fixed reference point carried on the window will successively indicate each marking of the band of color appearing in the window.

When a transparent cover member carrying reference means is employed, the distinguishable color corresponding to the proper unit of time is indicated by rotation between the annular member and the cover member carrying the reference means. When carried by the cover member, the reference means can be any convenient means of indication such as, for example, a pointer, a line, an aperture or a bar, a groove or dot embedded in or affixed to a transparent cover or the window of an opaque cover member or any combination of such or other common marking indica. The reference point can also be regarded as one boundary of an aperture. The separate reference point indicator or reference means, which is preferably mounted below the cover member, may be a lance, wire pointer or similar device and, when it is intended to rotate the annular member, the reference means is conveniently mounted on the shaft carrying the cover member.

The above assembly is usually mounted in a housing or case to protect the inner mechanism from dirt or other foreign matter. However, the cover member can be extended in a continuous and suitable configuration so as to enclose the assembly and thus comprise the housing of a timepiece having a reduced number of component parts.

Figure 6:
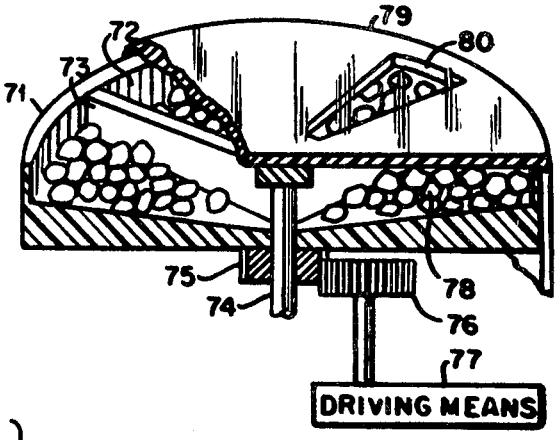

For a better understanding of this invention, reference is now directed to the drawings which provide examples of specific and preferred embodiments included within the scope of the invention. Each of the following figures illustrating certain embodiments refers to essential elements of the invention which are defined herein and which are operated in accordance with the description set forth on the preceeding pages of this application. The FIGURES are perspective view of specific timepieces within the scope of this invention. FIG. 6 is a cutaway view showing an internal structure of a hollow case annular member, the panels forming the sections and the color particles in the sections. However, these examples are not to be construed as limiting to the scope of the invention, and many additional variations and dissimilar embodiments, both in structure and design, will become apparent to those skilled in the art from the teaching of this disclosure.

A particularly preferred timepiece of this invention includes a substantially flat annular plate member having coded on its upper flat surface or display portion, four similar sections each having a distinctly different color, each section being uniformly subdivided into shades of the corresponding distinct color so as to provide 12 distinguishable colors in 12 similar sections comprising the display portion wherein each section represents one hour of a 12-hour period. Each subdivision carries five markings evenly spaced across the distinguishable color section to indicate 10-minute intervals within each hour period. This particular timepiece also includes an annular opaque or translucent cover member positioned over the upper flat surface of the annular plate member which covers the distinguishable colors carried thereon, said cover member having a window on which is marked a fixed reference point and said window being located so as to display at least one of the distinguishable color sections and to successively align the reference point positioned on the window with each of the subdivision markings of the distinguishable color sections when one member is rotated with respect to the other within the time period indicated. Driving means for this timepiece comprises the standard driving means which normally actuates the hour hand of an ordinary watch or clock except that shaft and minute driving mechanism are eliminated and the shaft which normally engages the hour hand is instead connected to the axis portion of the rotatable member (i.e., the cover member or the annular member) and is thus actuated by the standard timepiece hour driving mechanism. A timepiece of this general type is illustrated in perspective view by FIG. 1 where 2 is a substantially flat annular member fixedly mounted on a shaft 3 and carrying on its display surface 5 four uniform color sections of distinctly different colors arranged in wedge shaped color areas 6; each of said color areas being subdivided into uniform sections 7, 7' and 7'' having varying color intensities of the respective distinct color to provide 12 cuneiform areas of distinguishable colors which in this embodiment represents the 12-hours of a day. Transparent cover member 8 having a knife edged bar 4 embeded in the transparent material as reference point 10, is fixedly mounted over the annular member and is enclosed and integrally mounted in a case or housing (not shown). Passing through boss 13 at the axis of the annular member 2 is shaft 3 which is geared at its lower end 9 and is actuated by gear wheel 14 connected to standard hour driving means 15 of an ordinary timepiece. Each color section carries 11 markings 11 to indicate 5-minute intervals of each hour period as the annular member is rotated and the markings are aligned with bar 4 and reference point 10. It is to be understood, however, that in the figures of the drawings, any convenient number of markings of any desired shape and in any configuration can be carried in each color section to indicate the same or different intervals of the time period represented on the annular member. It is also to be understood that a suitable number of distinguishable color sections comprising the color arrangement can be used to represent any time period desired, such as for example, 12 or 24 hours of a day or minutes of an hour.

Figure 2:
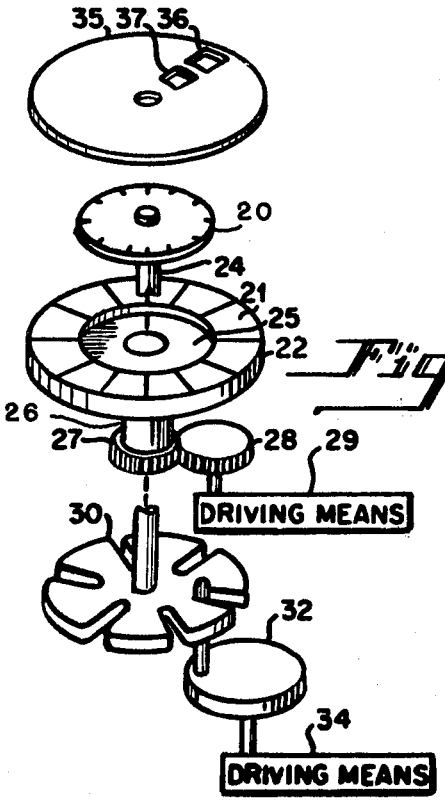

FIG. 2 is an exploded isometric view of a timepiece wherein hours are indicated by numerals on annular plate 20 fixedly mounted on rotatable shaft 24 and five minute intervals of the hour are indicated by distinguishable colors in sections 21 on a separate and independently rotatable annular member 22 having a central annular indentation 25 of slightly larger diameter than the diameter of annular member 20. Annular member 22 is integrally mounted on rotatable hollow shaft 26 which has an inside diameter slightly larger than the shaft 24. The lower end of shaft 26 carries gear 27 and the lower end of shaft 24 carries gear 30. Annular plate 20, axially mounted on shaft 24, is concentrically mounted within annular member 22 and shaft 26 in a telescoping arrangement so that shaft 24 extends beyond the geared portion of shaft 26. Gear 27 is adapted to engage gear wheel 28 which is driven by driving means 29 which normally actuates the minute hand of an ordinary timepiece and gear 30 is adapted to engage gear wheel 32 which is driven by driving means 34 which normally actuates the hour hand of an ordinary watch or clock. Thus, annular member 22 and annular member 20 are adapted to rotate independently at different rates, i.e. annular member 22 making a complete rotation within each hour period and annular member 20 making a complete rotation within each 12-hour period. Opaque cover member 35 is adapted to be positioned over the assembly of rotating annular members 20 and 22. The cover member is equipped with window 36 positioned adjacent a distinguishable color section to indicate the distinguishable color corresponding to the proper interval of one hour and window 37, positioned over a numeral of annular member 20 to indicate the proper hour of the 12-hour period. The cover member is fixedly mounted in a common timepiece casing which encloses the entire assembly including the driving means.

In the arrangement where one of the time periods is indicated by a numeral, gear 30 can be of an indexing type so that one complete numeral is advanced to align with the reference point at each interval of change. Of the many possible arrangements for accomplishing this intermittant movement, a geneva mechanism comprising a star wheel gear for engagement with a pin carried on a driving wheel can be employed. In this case, the driving wheel carrying the pin which engages the slots of the star wheel is substituted for the geared driving wheel of an ordinary timepiece which is connected to the standard driving mechanism. A more simplified arrangement comprises gear 30 engageable with a gear wheel which is geared at intermittant and uniformly spaced intervals around its perifery and which is driven by a standard driving means.

Figure 3:
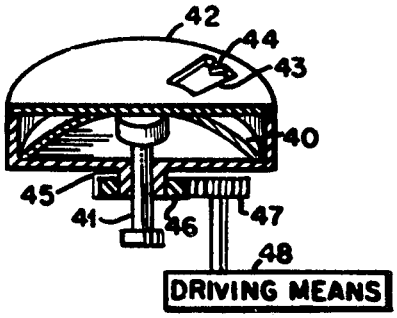

FIG. 3 is a perspective view of a timepiece having a bowed annular member 40 which is integrally mounted on unmoveable shaft 41 and which carries a display area on its upper surface where uniform divisions of a time period are indicated by uniform sections of distinguishable color and by the successive placement of each section at a point of reference. Completely enclosing annular member 40 and a portion of shaft 41, is opaque cover member 42 equipped with window 43 on which is mounted pointer 44. The window is positioned over the display area and is of such size and shape as to reveal one complete color section having a distinguishable color. The cover member which is a continuous housing enclosing the annular member, carries a hollow sleeve 45 on its under side adapted to encase the upper portion of shaft 41 on which the annular member is mounted, the opposite end portion of shaft 41 being allowed to extend beyond the hollow sleeve portion. Sleeve 45 is geared at its lower end with gear 46 for engagement with gear wheel 47. Gear wheel 47 is driven by standard driving means 48 which engages gear 46 to cause the cover member to make a complete revolution within the time period desired, eg. a 12-hour or a one hour period.

Figure 4:
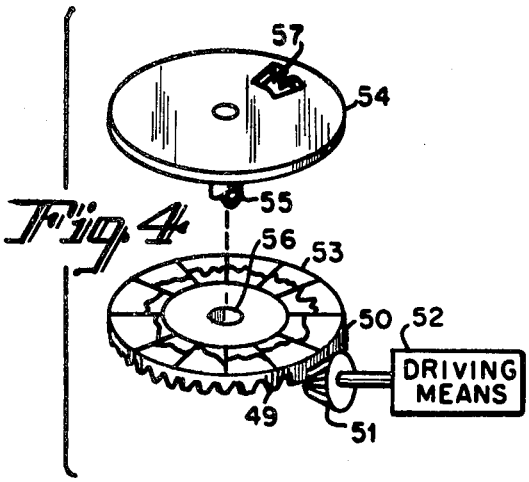

FIG. 4 is an exploded isometric view of a timepiece wherein a bevel gear 49 on the under side of annular member 50 engages gear wheel 51 which is actuated by standard driving means 52 so as to cause the annular member to make a complete rotation within the time period selected. Annular member 50 displays on its upper surface 12 uniform sections 53 in which distinguishable colors in varied patterns appear. Opaque cover member 54 is fixedly mounted on unmoveable shaft 55 which passes through aperture 56 at the axis of annular member 50. Slot 57 having about the same dimension and shape as a color section of the annular member is carried by the cover member in a position adjacent a section of the display area so as to indicate each of the distinguishable colors of each section as the annular member is rotated by the bevel gear actuated by standard driving means 52.

Figure 5:
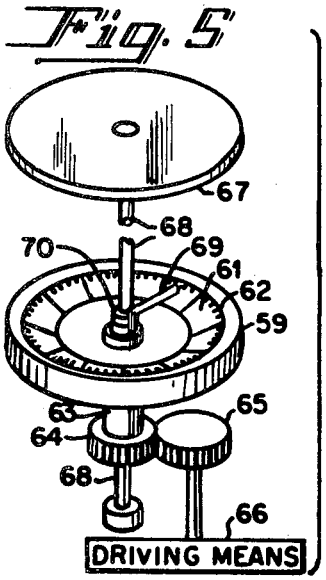

FIG. 5 is a perspective view of a timepiece wherein annular member 59 is a dish-like member having a depth of about 1/6th its diameter and having a display area angularly disposed around the inner wall of member 59. The display area is uniformly divided into 12 sections 61 which represent hours of a 12-hour period. Each section is color distinguishable from the remaining sections and carries around its upper periphery five markings 62 which represent 10 minute intervals of each hour. Annular member 59 is fixedly mounted on rotatable hollow shaft 63 which is geared at its lower end with gear 64 and adapted to engage gear wheel 65 which in turn is driven by driving means 66 ordinarily engaging the hour hand of a standard timepiece. Transparent cover member 67 is fixedly mounted on unmovable shaft 68 which is adapted to pass through the hollow cavity of shaft 63. Also fixedly mounted on shaft 68 between cover member 67 and annular member 59 is a collar 70 on which is mounted a separate reference point indicator 69. The reference point indicator is adapted to be aligned with each of the five markings within each color section as annular member 59 is rotated beneath the transparent cover member 67 and fixed reference means 69. It is to be understood that both annular member 59 and cover member 67 can be stationary and reference means 69 can be rotated by fixedly mounting cover 67 in a casing and having only 69 mounted on shaft 68 which can be adapted for rotation by substituting gear 64 on shaft 68 instead of shaft 63 and causing rotation by gear wheel 65 and driving means 66.

FIG. 6 is a perspective view of annular member 71 which is a hollow case divided into 10 sections 72 by panels 73. Hollow case 71 is integrally mounted on rotatable shaft 74 which is geared at its lower end with gear 75 and adapted to engage gear wheel 76 which is driven by driving means 77 of a standard timepiece which ordinarily rotates the minute hand. Each of the sections of case 71 contains a plurality of variously shaped color bodies 78 having substantially the same color and distinguished by color from the color bodies in the remaining sections. Over case 71 is fixedly mounted opaque cover member 79 having window 80 designed to fit the contour of each section 72 and adapted to reveal the freely moving color bodies in each section as the case member 71 is rotated within an hour period. Cover member 79 is a continuous housing having side and base portions which enclose case 71, gears 75 and 76 and driving means 77. Alternately, said driving means can be positioned on a base and the cover member extended to rest on the base. Another obvious variation is where the cover member is a simple circular apertured disk as in the above figures.

Figure 7:
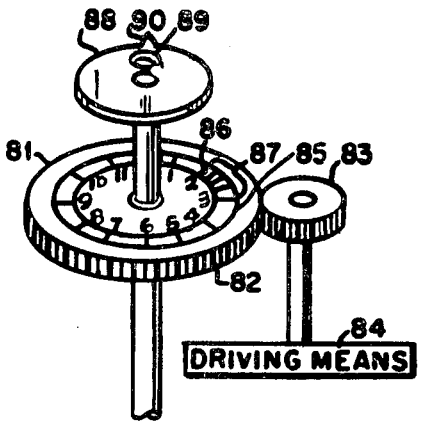

FIG. 7 is a perspective view of a timepiece arrangement wherein annular member 81 is geared around its periphery 82 to engage gear wheel 83 which is driven by standard timepiece driving means 84 and which ordinarily drives the hour hand of a standard timepiece. Annular member 81 carries numerals 1 to 12 successively arranged around its axis and a color display area 85 arranged in sections 86 in an outer annular band around its periphery. Each section contains a repetition of 4 distinguishable colors 87 and a section is provided for each of the numerals 1–12 to provide indication of 15-minute intervals of an hour as the annular member is rotated. Opaque cover member 88 is adapted to fit over annular member 81 and has a smaller diameter than annular member 81 such that color sections around the periphery of the annular member are beyond the circumference of opaque cover member 88 and are not masked by 88. The cover member is equipped with an aperture 89 positioned over a numeral to disclose each of the numerals successively as annular plate 81 is rotated. The cover member also carries reference pointer 90 adapted to indicate a color of a given section corresponding to the 15-minute interval of the hour.

Figure 8:
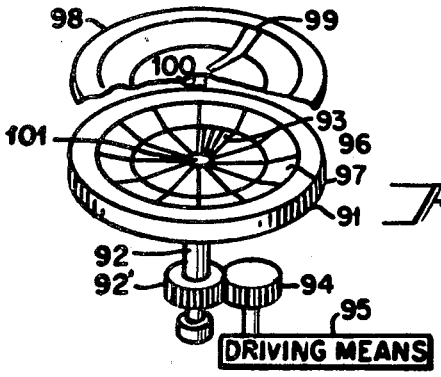

FIG. 8 is a perspective view of a timepiece arrangement wherein two different time periods are simultaneously displayed by different color codes. Centrally apertured annular member 91 is fixedly mounted on hollow shaft 92 which is geared at its lower end with gear 92′ for engagement with gear wheel 94. Gear wheel 94 is actuated by the hour driving means of a standard timepiece. The upper surface of annular member 91 is dish-shaped and 12 sections of distinguishable colors 97 are angularly positioned in a band around the depressed wall of the dish-shaped body. Four uniform subdivided sections 93, each of a distinctly different color, are repeated for each of the sections 97 around the flat base portion of the dish-shaped body. Translucent cover member 98 completely covers annular member 91 and is similarly dish-shaped to follow the contour of the annular member. The cover member is fixedly mounted on stationary shaft 100 which passes through aperture 101 and hollow shaft 92 of member 91. Cover member 98 carries a pair of apertures, one of which coincides with a subsection 93 and the other with section 97, or one aperture 99 having a width at its base which is equal to one of the subdivided sections 93 and slightly flared on its depressed wall portion to reveal color section 97 as member 91 is uniformly rotated below cover member 98. It is to be understood that the location of sections 97 and subsections 93 can be reversed. However in this case, aperture 99 is preferably of a uniform width which coincides with the width of one subdivision. Also each of the four subdivided sections can be of the same color but distinguished each from the other in the group of four by different configurations or patterns or different color intensities.

For example, the subsections can comprise a dotted, a horizontally striped, a cross hatched, and a vertically striped area.

A variation of FIG. 1 wherein the cover member is rotated is shown in FIG. 1A. FIG. 1A is a perspective view of this variation where 2′ is a substantially flat annular member fixedly mounted on a shaft 3′ and carrying on its display surface 5′ four uniform color sections of distinctly different colors arranged in wedge shaped color areas 6'; each of said color areas being sub-divided into uniform sections 17, 17', and 17'' having varying color intensities of the respective distinct color to provide 12 uniform areas of distinguishable colors which in this embodiment respresent the 12-hours of a day. Transparent cover member 8' having a knife edged bar 4' embedded in the transparent material as reference point 10', is mounted over the annular member on shaft 18'. Passing through boss 13' at the axis of the annular member 2' is shaft 3' on which the annular member is fixedly mounted. Passing through shaft 3' is shaft 18' which is geared at its lower end 9' and is actuated by gear wheel 14' connected to standard hour driving means 15' of an ordinary timepiece. Each color section carries 11 markings; 11' to indicate 5-minute intervals of each hour period as the cover member is rotated and the markings are aligned with bar 4' and reference point 10'.

FIG. 5A is a perspective view of a timepiece wherein the reference point indicator is rotated. In this embodiment, annular member 59' is a dish-like member having a depth of about 1/6th its diameter and having a display area angularly disposed around the inner wall of member 59'. The display area is uniformly divided into 12 sections 61' which represent hours of a 12-hour period. Each section is color distinguishable from the remaining sections and carries around its upper periphery five markings 62' which represent 10 minute intervals of each hour. Annular member 59' is fixedly mounted on immovable hollow shaft 63'. Transparent cover member 67' is fixedly mounted in a timepiece casing (not shown). A shaft is adapted to pass through the hollow cavity of shaft 63' and is geared at its lower end with gear 64' and adapted to engage gear wheel 65' which in turn is driven by driving means 66' ordinarily engaging the hour hand of a standard timepiece.

Fixedly mounted on shaft 68' between cover member 67' and annular member 59' is a collar 70' on which is mounted reference point indicator 69'. The reference point indicator is adapted to be alligned with each of the five markings within each color section as it is rotated by shaft 68' beneath the transparent cover member 67' and above sections 61' of annular member 59'.

In each of the above figures either the annular or the cover member carrying the reference means can be rotated. For example, in FIG. 3 the annular member can be fixedly mounted and the cover member can carry side and bottom portions which substantially encase annular member 40. The side or bottom portion of the cover member can be geared to engage gear wheel 43. Similarly, in FIG. 6, the cover member 86 can be geared around its periphery instead of annular member 80 to engage gear wheel 82 for rotational movement. In any of the remaining figures, the portion of the cover member shaft extending beyond the shaft of the annular member may be geared for rotational movement in place of, or in addition to, the gear which actuates the annular member.

Also, in any of the above figures, the cover member may be eliminated or a transparent cover member employed and a suitable reference means, such as for example, a lance, a bar, a pointer or other suitable indicator having shape and form can be separately mounted over the display portion of the annular member, e.g., as in the variation described for FIG. 5. When the reference means over the display portion is mounted on a separate shaft, the shaft may, or may not, be geared and adapted to engage the gear wheel of a standard timepiece driving mechanism, depending on whether it is desirable to rotate the reference means or the annular member for successive indication of the distinguishable colors.

These and many additional embodiments and variations will be apparent to those skilled in the art from the above description, disclosure and drawings.

Having thus described my invention, I claim:

1. In a timepiece having a single reference means associated with distinguishable colors of a color arrangement which comprises in combination:

(a) a standard timepiece driving means connected through a gear means to a rotatable member causing said rotatable member to complete a rotation in a single time period;

(b) at least one annular member having a solid diameter surface;

(c) an annular display portion on the visible surface of said annular member having uniformly divided color sections, each section representing a uniform unit of time within a single predetermined time period which is the hours in a day or the minutes in an hour;

(d) said sections of said annular display distinguished each from the others by a distinguishable color in each of said sections and said units of time within the single predetermined time period being represented solely by the colors of said sections;

(e) not more than one solitary reference means associated with said colored sections for indicating colors on said annular member;

(f) said timepiece having at least one time period displayed by said color arrangement which color arrangement is distinguished from any other time period displayed by the timepiece; and (g) a gear means connected to said standard driving means and said rotatable member for causing relative rotational movement between said colored display portion on said annular member and said solitary reference means associated with said colored sections of said annular member such that each of the distinguishable colors representing cumulative units of the time period are successively positioned at said solitary reference means associated with the display area of distinguishable colors within the time period, whereby said solitary reference means associated with color indicates at least a portion of one of said sections carrying a distinguishable color, thereby successively and progressively identifying each of the intervals of elapsed time within the time period, the improvement which comprises:

a cover member mounted over the display portion of the annular member adapted to reveal at least one section of said display portion, said solitary reference means associated with the display area of distinguishable colors being fixedly positioned on said cover member so as to be adapted to indicate one section of said display portion, said display portion of said annular member being stationary, and said cover member being mounted on a shaft having gear means adapted to engage said standard driving means whereby said reference means is rotated by rotating said cover member.

2. The timepiece as recited in claim 1 wherein the cover member is nontransparent and carries an aperture which coincides with a single section of the display portion of said annular member while the remaining sections are masked and wherein said aperture is the solitary reference means associated with the display area of distinguishable colors.

3. The timepiece as recited in claim 1 wherein the cover member is transparent so as to reveal all of the colored sections of the display portion of the annular member and said solitary reference means associated with the display area of distinguishable colors is a defined radius on said cover member.

4. In a timepiece having a single reference means associated with distinguishable colors of a color arrangement which comprises in combination:

(a) a standard timepiece driving means connected through a gear means to a rotatable member causing said rotatable member to complete a rotation in a single time period;

(b) at least one annular member having a solid diameter surface;

(c) an annular display portion on the visible surface of said annular member having uniformly divided color sections, each section representing a uniform unit of time within a single predetermined time period which is the hours in a day or the minutes in an hour;

(d) said sections of said annular display distinguished each from the others by a distinguishable color in each of said sections and said units of time within the single predetermined time period being represented solely by the colors of said sections;

(e) not more than one solitary reference means associated with said colored sections for indicating colors on said annular member;

(f) said timepiece having at least one time period displayed by said color arrangement which color arrangement is distinguished from any other time period displayed by the timepiece; and (g) a gear means connected to said standard driving means and said rotatable member for causing relative rotational movement between said colored display portion on said annular member and said solitary reference means associated with said colored sections of said annular member such that each of the distinguishable colors representing cumulative units of the time period are successively positioned at said solitary reference means associated with the display area of distinguishable colors within the time period, whereby said solitary reference means associated with color indicates at least a portion of one of said sections carrying a distinguishable color, thereby successively and progressively identifying each of the intervals of elapsed time within the time period, the improvement which comprises: a cover member mounted over the display portion of the annular member which is adapted to reveal at least one section of said annular display portion, a stationary display portion of the annular member and said cover member mounted on a shaft having gear means adapted to engage said standard driving means so that the solitary reference means associated with the display area of distinguishable colors, which is fixedly positioned on said cover member, is rotated by rotating said cover member in the period of one hour and a plurality of subsections designating a second time period carried by said annular member and uniformly spaced across each section of the display portion so that the sections and subsections are simultaneously and successively positioned at the solitary reference means associated with the display area of distinguishable colors by said relative rotational movement.

5. In a timepiece having a single reference means associated with distinguishable colors of a color arrangement which comprises in combination:

(a) a standard timepiece driving means connected through a gear means to a rotatable member causing said rotatable member to complete a rotation in a single time period;

(b) at least one annular member having a solid diameter surface;

(c) an annular display portion on the visible surface of said annular member having uniformly divided color sections, each section representing a uniform unit of time within a single predetermined time period which is the hours in a day or the minutes in an hour;

(d) said sections of said annular display distinguished each from the others by a distinguishable color in each of said sections and said units of time within the single predetermined time period being represented solely by the colors of said sections;

(e) not more than one solitary reference means associated with said colored sections for indicating colors on said annular member;

(f) said timepiece having at least one time period displayed by said color arrangement which color arrangement is distinguished from any other time period displayed by the timepiece; and (g) a gear means connected to said standard driving means and said rotatable member for causing relative rotational movement between said colored display portion on said annular member and said solitary reference means associated with said colored sections of said annular member such that each of the distinguishable colors representing cumulative units of the time period are successively positioned at said solitary reference means associated with the display area of distinguishable colors within the time period, whereby said solitary reference means associated with color indicates at least a portion of one of said sections carrying a distinguishable color, thereby successively and progressively identifying each of the intervals of elapsed time within the time period, the improvement which comprises: a plurality of uniformly spaced subsections for each section carried by said annular member in a separate annual area of the display portion, the subsections of each section being differentiated by a distinguishable arrangement of colors which distinguishable arrangement is repeated in each group of subsections associated with each section of the display portion of said annular member and successively positioning said sections and subsections at the solitary reference means associated with the display area of distinguishable colors by said relative rotational movement.

6. The timepiece as recited in claim 5, wherein said solitary reference means associated with the display area of distinguishable colors and positioned on a cover member, is stationary, and wherein at least the display portion of said annular member is mounted on a shaft having gear means adapted to engage said standard driving means for rotating said display portion of said annular member past said reference means on said cover member.

7. In a timepiece having a single reference means associated with distinguishable colors of a color arrangement which comprises in combination:

(a) a standard timepiece driving means connected through a gear means to a rotatable member causing said rotatable member to complete a rotation in a single time period;

(b) at least one annular member having a solid diameter surface;

(c) an annular display portion on the visible surface of said annular member having uniformly divided color sections, each section representing a uniform unit of time within a single predetermined time period which is the hours in a day or the minutes in an hour;

(d) said sections of said annular display distinguished each from the others by a distinguishable color in each of said sections and said units of time within the single predetermined time period being represented solely by the colors of said sections;

(e) not more than one solitary reference means associated with said colored sections for indicating colors on said annular member;

(f) said timepiece having at least one time period displayed by said color arrangement which color arrangement is distinguished from any other time period displayed by the timepiece; and (g) a gear means connected to said standard driving means and said rotatable member for causing relative rotational movement between said colored display portion on said annular member and said solitary reference means associated with said colored sections of said annular member such that each of the distinguishable colors representing cumulative units of the time period are successively positioned at said solitary reference means associated with the display area of distinguishable colors within the time period, whereby said solitary reference means associated with color indicates at least a portion of one of said sections carrying a distinguishable color, thereby successively and progressively identifying each of the intervals of elapsed time within the time period, the improvement which comprises: an annular cover member is mounted above the annular member and is of a smaller dimension than said annular member so as to reveal all of the color sections in the display area of the annular member around the periphery of the cover member and said solitary reference means associated with the display area of distinguishable colors is an indicator mounted on the periphery of said cover member.

8. In a timepiece having a single reference means associated with distinguishable colors of a color arrangement which comprises in combination:

(a) a standard timepiece driving means connected through a gear means to a rotatable member causing said rotatable member to complete a rotation in a single time period;

(b) at least one annular member having a solid diameter surface;

(c) an annular display portion on the visible surface of said annular member having uniformly divided color sections, each section representing a uniform unit of time within a single predetermined time period which is the hours in a day or the minutes in an hour;

(d) said sections of said annular display distinguished each from the others by a distinguishable color in each of said sections and said units of time within the single predetermined time period being represented solely by the colors of said sections;

(e) not more than one solitary reference means associated with said colored sections for indicating colors on said annular member;

(f) said timepiece having at least one time period displayed by said color arrangement which color arrangement is distinguished from any other time period displayed by the timepiece; and (g) a gear means connected to said standard driving means and said rotatable member for causing relative rotational movement between said colored display portion on said annular member and said solitary reference means associated with said colored sections of said annular member such that each of the distinguishable colors representing cumulative units of the time period are successively positioned at said solitary reference means associated with the display area of distinguishable colors within the time period, whereby said solitary reference means associated with color indicates at least a portion of one of said sections carrying a distinguishable color, thereby successively and progressively identifying each of the intervals of elapsed time within the time period, the improvement which comprises: gearing on the underside of the annular member which gearing is adapted to engage said gear means for rotating said annular member carrying said display area past the solitary reference means associated with the display area of distinguishable colors which is positioned over the display portion of said annular member.

9. In a timepiece having a single reference means associated with distinguishable colors of a color arrangement which comprises in combination:

(a) a standard timepiece driving means connected through a gear means to a rotatable member causing said rotatable member to complete a rotation in a single time period;

(b) at least one annular member having a solid diameter surface;

(c) an annular display portion on the visible surface of said annular member having uniformly divided color sections, each section representing a uniform unit of time within a single predetermined time period which is the hours in a day or the minutes in an hour;

(d) said sections of said annular display distinguished each from the others by a distinguishable color in each of said sections and said units of time within the single predetermined time period being represented solely by the colors of said sections;

(e) not more than one solitary reference means associated with said colored sections for indicating colors on said annular member;

(f) said timepiece having at least one time period displayed by said color arrangement which color arrangement is distinguished from any other time period displayed by the timepiece; and (g) a gear means connected to said standard driving means and said rotatable member for causing relative rotational movement between said colored display portion on said annular member and said solitary reference means associated with said colored sections of said annular member such that each of the distinguishable colors representing cumulative units of the time period are successively positioned at said solitary reference means associated with the display area of distinguishable colors within the time period, whereby said solitary reference means associated with color indicates at least a portion of one of said sections carrying a distinguishable color, thereby successively and progressively identifying each of the intervals of elapsed time within the time period, the improvement which comprises: a plurality of uniformly spaced subsections for each section carried by said annular member in a separate annual area of the display portion, the subsections of each section being differentiated by a distinguishable arrangement of patterns which distinguishable arrangement is repeated in each group of subsections associated with each section of the display portion of said annular member and successively positioning said sections and subsections at the solitary reference means associated with the display area of distinguishable colors by said relative rotational movement.

10. In a timepiece having a single reference means associated with distinguishable colors of a color arrangement which comprises in combination:

(a) a standard timepiece driving means connected through a gear means to a rotatable member causing said rotatable member to complete a rotation in a single time period;

(b) at least one annular member having a solid diameter surface;

(c) an annular display portion on the visible surface of said annular member having uniformly divided color sections, each section representing a uniform unit of time within a single predetermined time period which is the hours in a day or the minutes in an hour;

(d) said sections of said annular display distinguished each from the others by a distinguishable color in each of said sections and said units of time within the single predetermined time period being represented solely by the colors of said sections;

(e) not more than one solitary reference means associated with said colored sections for indicating colors on said annular member;

(f) said timepiece having at least one time period displayed by said color arrangement which color arrangement is distinguished from any other time period displayed by the timepiece; and (g) a gear means connected to said standard driving means and said rotatable member for causing relative rotational movement between said colored display portion on said annular member and said solitary reference means associated with said colored sections of said annular member such that each of the distinguishable colors representing cumulative units of the time period are successively positioned at said solitary reference means associated with the display area of distinguishable colors within the time period, whereby said solitary reference means associated with color indicates at least a portion of one of said sections carrying a distinguishable color, thereby successively and progressively identifying each of the intervals of elapsed time within the time period, the improvement which comprises: a first annular display of the hours in a day or the minutes in an hour displayed by said colored sections and a second annular display of indica different from the colored arrangement of the first time period, for displaying the remaining time period and said solitary reference means being adapted to be associated with both the first and second annular displays for simultaneous indication of the progression of elapsed time in the two time periods.

11. The timepiece of claim 10 wherein the indica of the second annular display is a separate color arrangement.

12. In a timepiece having a single reference means associated with distinguishable colors of a color arrangement which comprises in combination:

(a) a standard timepiece driving means connected through a gear means to a rotatable member causing said rotatable member to complete a rotation in a single time period;

(b) at least one annular member having a solid diameter surface;

(c) an annular display portion on the visible surface of said annular member having uniformly divided color sections, each section representing a uniform unit of time within a single predetermined time period which is the hours in a day or the minutes in an hour;

(d) said sections of said annular display distinguished each from the others by a distinguishable color in each of said sections and said units of time within the single predetermined time period being represented solely by the colors of said sections;

(e) not more than one solitary reference means associated with said colored sections for indicating colors on said annular member;

(f) said timepiece having at least one time period displayed by said color arrangement which color arrangement is distinguished from any other time period displayed by the timepiece; and (g) a gear means connected to said standard driving means and said rotatable member for causing relative rotational movement between said colored display portion on said annular member and said solitary reference means associated with said colored sections of said annular member such that each of the distinguishable colors representing cumulative units of the time period are successively positioned at said solitary reference means associated with the display area of distinguishable colors within the time period, whereby said solitary reference means associated with color indicates at least a portion of one of said sections carrying a distinguishable color, thereby successively and progressively identifying each of the intervals of elapsed time within the time period, the improvement which comprises: a first time period of the timepiece displayed by said annular display, a second time period in the timepiece represented by separate and distinctive markings in a separate annular display on the same annular member which carries the annular display of the first time period and said solitary reference means associated with said colored sections simultaneously and progressively indicating each of the intervals of elapsed time within the two time periods.

13. In a timepiece having a single reference means associated with distinguishable colors of a color arrangement which comprises in combination:

(a) a standard timepiece driving means connected through a gear means to a rotatable member causing said rotatable member to complete a rotation in a single time period;

(b) at least one annular member having a solid diameter surface;

(c) an annular display portion on the visible surface of said annular member having uniformly divided color sections, each section representing a uniform unit of time within a single predetermined time period which is the hours in a day or the minutes in an hour;

(d) said sections of said annular display distinguished each from the others by a distinguishable color in each of said sections and said units of time within the single predetermined time period being represented solely by the colors of said sections;

(e) not more than one solitary reference means associated with said colored sections for indicating colors on said annular member;

(f) said timepiece having at least one time period displayed by said color arrangement which color arrangement is distinguished from any other time period displayed by the timepiece; and (g) a gear means connected to said standard driving means and said rotatable member for causing relative rotational movement between said colored display portion on said annular member and said solitary reference means associated with said colored sections of said annular member such that each of the distinguishable colors representing cumulative units of the time period are successively positioned at said solitary reference means associated with the display area of distinguishable colors within the time period, whereby said solitary reference means associated with color indicates at least a portion of one of said sections carrying a distinguishable color, thereby successively and progressively identifying each of the intervals of elapsed time within the time period, the improvement which comprises: a first time period of the timepiece displayed by said annular display, a second time period in the timepiece represented and distinguishable from the first by separate and distinctive markings in an annular display on a separate, second annular member and a separate, second reference means indicating elapsed time of the second time period by relative rotational movement between the second annular member and said separate, second reference means which relative rotational movement is effected by a second gear means actuated by said standard timepiece driving means and causing rotational movement between said second reference means and said second annular member.

14. The timepiece of claim 13 wherein the annular member recited therein is a first annular member and wherein another, second annular member is employed to separately display a second time period; the first of the two annular members carries 12 distinguishable sections in a color display portion around its outer periphery, said sections representing the hours in a day and wherein the second of the two annular members carries distinguishable sections in an annular display portion around its outer periphery, said sections on said second annular member representing uniform minute divisions of an hour period; the annular members are of different diameters and are positioned so that the display portion of the larger annular member extends beyond the display portion of the smaller annular member; the first annular member has a first display portion in which the sections are differentiated each from the others by distinguishable colors and the second annular member has a second display portion in which the sections are differentiated each from the others by markings; the solitary reference means associated with the display area of distinguishable colors is stationary while said first annular member carrying said colors is rotated by the standard timepiece driving means corresponding to the time period displayed by said colored sections; a second, separate reference means is employed for association with said second annular member associated with sections carrying said markings; said second reference means is stationary while said second annular member is rotated by the standard timepiece driving means corresponding to the time period displayed by the sections which carry said markings; and said driving means of the timepiece consists of a standard hour driving means and a standard minute driving means of a standard timepiece which driving means are attached to the rotatable members of the corresponding time periods.

15. In a timepiece having a single reference means associated with distinguishable colors of a color arrangement which comprises in combination:

(a) a standard timepiece driving means connected through a gear means to a rotatable member causing said rotatable member to complete a rotation in a single time period;

(b) at least one annular member having a solid diameter surface;

(c) an annular display portion on the visible surface of said annular member having uniformly divided color sections, each section representing a uniform unit of time within a single predetermined time period which is the hours in a day or the minutes in an hour;

(d) said sections of said annular display distinguished each from the others by a distinguishable color in each of said reactions and said units of time within the single predetermined time period being represented solely by the colors of said sections;

(e) not more than one solitary reference means associated with said colored sections for indicating colors on said annular member;

(f) said timepiece having at least one time period displayed by said color arrangement which color arrangement is distinguished from any other time period displayed by the timepiece; and (g) a gear means connected to said standard driving means and said rotatable member for causing relative rotational movement between said colored display portion on said annular member and said solitary reference means associated with said colored sections of said annular member such that each of the distinguishable colors representing cumulative units of the time period are successively positioned at said solitary reference means associated with the display area of distinguishable colors within the time period, whereby said solitary reference means associated with color indicates at least a portion of one of said sections carrying a distinguishable color, thereby successively and progressively identifying each of the intervals of elapsed time within the time period, the improvement which comprises: said annular member being a substantially flat hollow case.

16. The timepiece as recited in claim 15 wherein said annular member is a substantially flat hollow case which is internally divided into cuneiform sections by radial panels.

17. The timepiece as recited in claim 16 wherein each section contains a plurality of color particles which are freely movable within each section.

18. The timepiece as recited in claim 16 wherein each section contains a plurality of color particles which are fixedly mounted on the upper surface of the base of said flat hollow case.

* * * * *